US005366345A

United States Patent [19]

Gerdes et al.

[11] Patent Number: 5,366,345

[45] Date of Patent: Nov. 22, 1994

[54] TURBINE BLADE OF A BASIC TITANIUM ALLOY AND METHOD OF MANUFACTURING IT

[75] Inventors: Claus Gerdes; Carlo Maggi, both of Baden, Switzerland

[73] Assignee: Asea Brown Boveri Ltd., Baden, Switzerland

[21] Appl. No.: 802,320

[22] Filed: Dec. 4, 1991

[30] Foreign Application Priority Data

Dec. 19, 1990 [EP] European Pat. Off. ..... 90124757.7

[51] Int. Cl.[5] ..... B63H 1/26

[52] U.S. Cl. ..... 416/241 R; 416/223 R; 416/229 A; 416/241 B; 427/554; 427/255.2

[58] Field of Search ..... 416/223 R, 223 A, 229 R, 416/229 A, 241 R, 224, 241 B; 427/554, 255.2, 255.4, 585, 586

[56] References Cited

U.S. PATENT DOCUMENTS

| | | | |
|---|---|---|---|
| 3,637,320 | 1/1972 | Wakenfield | 416/224 |
| 3,784,402 | 1/1974 | Reedy, Jr. | 427/255.2 |
| 4,247,529 | 1/1981 | Mori et al. | 423/380 |
| 4,299,860 | 11/1981 | Schaefer et al. | 416/241 R |
| 4,364,969 | 12/1982 | Dearnaley et al. | 427/554 |
| 4,745,033 | 5/1988 | Timmons | 416/241 |
| 4,817,858 | 4/1989 | Verpoort | 416/223 R |
| 4,832,993 | 5/1989 | Coulon | 416/241 R |
| 4,871,582 | 10/1989 | Miyabayashi | 427/554 |

FOREIGN PATENT DOCUMENTS

| | | | |
|---|---|---|---|
| 0249092 | 12/1987 | European Pat. Off. . | |
| 0282831 | 9/1988 | European Pat. Off. . | |
| 3905347A1 | 8/1990 | Germany . | |
| 0113802 | 5/1987 | Japan | 416/241 R |
| 0100302 | 4/1989 | Japan | 416/241 R |
| 1479855 | 7/1977 | United Kingdom . | |

OTHER PUBLICATIONS

Patent Absracts of Japan, vol. 11, No. 397, Dec. 25, 1987, "Turbine Blade", Toshiba Corp. (JP-A-62 165 510).

Patent Abstracts of Japan, vol. 12, No. 28, Jan. 27, 1988, "Low Pressure Turbine Moving Vane for Steam Turbine", Hitachi Ltd. (JP-A-62 180 026).

*Primary Examiner*—Thomas E. Denion

*Attorney, Agent, or Firm*—Burns, Doane, Swecker & Mathis

[57] ABSTRACT

A turbine blade, preferably used in the low pressure stages of a steam turbine, is formed from a basic titanium alloy. Near the blade tip, it has a region, including the blade leading edge with a surface of a material which is more resistant to erosion than the basic titanium alloy.

This turbine blade should be simple to manufacture and should have a long life even under difficult operating conditions.

This is achieved in that the region including the blade leading edge has a protective layer formed by surface treatment of the basic titanium alloy by means of a high-power energy source, such as, in particular, a laser.

9 Claims, 1 Drawing Sheet

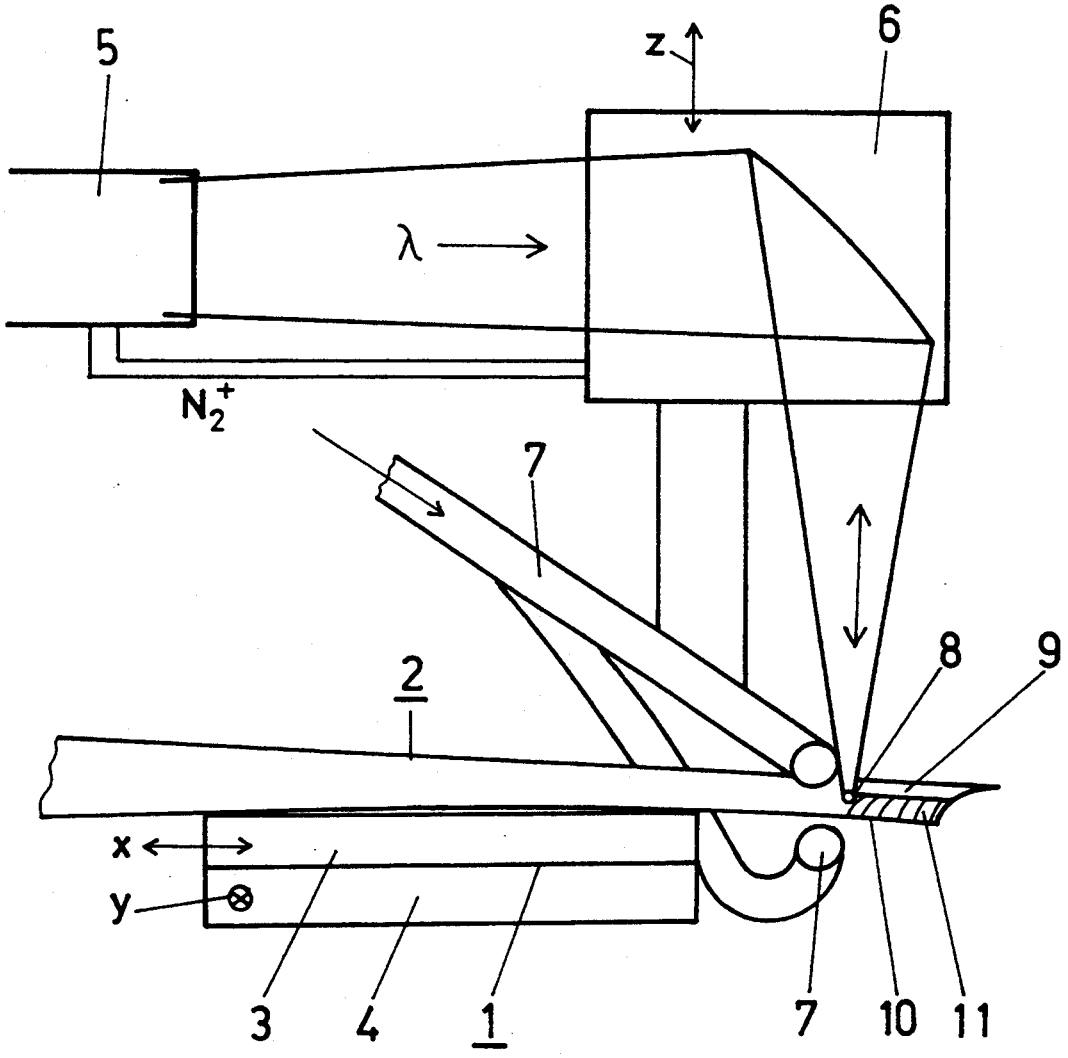
5
z
6
λ
$N_2^+$
7
2
8
9
x
y
3
4
1
7
10
11

TURBINE BLADE OF A BASIC TITANIUM ALLOY AND METHOD OF MANUFACTURING IT

BACKGROUND OF THE INVENTION

1. Field of the Invention

The invention is based on a turbine blade of a basic titanium alloy in which at least the region of the blade tip at the blade leading edge has a surface of a material which is more resistant to erosion than the basic titanium alloy. Such blades are preferentially used in the low pressure stages of steam turbines because, despite their size, they meet the mechanical strength requirements arising in this area at temperatures of around 100° C. and do not excessively increase the rotor stresses. In this temperature range, the steam entering the turbine condenses and water droplets hit at high velocity against the turbine blade surfaces exposed to the entering steam. These surfaces are, in particular, the blade leading edges and the parts of the blade surface following on from the blade leading edges on the suction side. The water droplets can cause erosion damage. The blade regions located near the blade tips are particularly affected by this because the peripheral velocity of the blades is greatest at this point.

2. Discussion of Background

A turbine blade of the type mentioned at the beginning is known, for example, from GB-A-1479855 or EP-B1-0249092. The known turbine blade has, in the region of the blade tip, a blade region which includes the blade leading edge and was manufactured by brazing, by means of a silver braze or copper braze, a protective body containing titanium carbide onto a basic titanium alloy turbine blade without a protective body. Such a protective body is intended particularly to protect endangered regions of the turbine blade from erosion damage. The manufacture and application of the protective body to the turbine blade without a protective body are relatively complicated. In this arrangement, furthermore, difficulties with respect to the adhesion of the protective body on the basic titanium alloy of the titanium blade without protective body cannot be excluded.

SUMMARY OF THE INVENTION

Accordingly, one object of this invention is to provide a novel turbine blade, of the type mentioned at the beginning, which is simple to manufacture and displays a long life even under difficult operating conditions and to provide a method by means of which such a blade can be manufactured in a cost-effective manner and in a manner suitable for mass production.

In the case of the turbine blade according to the invention, surface-hardening of the blade region treated and, therefore, effective protection against droplet erosion is achieved in a single process step, namely surface treatment of the unprotected basic titanium alloy by means of a high-power energy source. This erosion protection is particularly reliable because, on the one hand, a protective layer solidly connected to the basic titanium alloy is formed by the surface treatment as a consequence of diffusion processes. Given a suitable layer thickness, on the other hand, this protective layer also displays a low crack sensitivity which is comparable with that of the basic titanium alloy.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single FIGURE shows, in a diagrammatic representation, a device for manufacturing a turbine blade according to the invention.

DESCRIPTION OF THE PREFERRED EMBODIMENTS

Referring now to the drawing, the device shown in the FIGURE contains a supporting table 1, displaceable in a horizontal plane, having a supporting plate 3 carrying a turbine blade 2 and displaceable in the direction of a coordinate axis x and having a bottom plate 4 supporting the supporting plate 3 and movable along a coordinate axis y at right angles to the x axis. A laser generating light of wavelength lambda is indicated by 5. The light generated by the laser is focused onto the turbine blade in a treatment head 6. If appropriate, a different high-power energy source, such as a device for generating a plasma beam or an electron beam, can be used instead of a laser. The treatment head 6 can be displaced at right angles to the supporting plate 3 in the direction of a coordinate axis z and, if required, can be simultaneously pivoted about the x axis and about the y axis. The coordination of the motions of the treatment head 6 and the supporting table 1 solidly connected to the high-power energy source can take place by means of a memory-programmed control unit (not shown) which acts on servomotors causing the displacement and pivoting motions.

Tubes 7, which supply a nitrogen/argon gas mixture, or if necessary a mixture of nitrogen with one or more arbitrary inert gases, from a reservoir (not shown) to a laser point of action 8 of the high-power energy source on the suction-side surface 9 or the blade leading edge 10 of the turbine blade 2, are fastened to the treatment head 6. The gas supplied is free from oxygen and floods the laser point of action 8 forming the traces 11 in such a way that oxygen from the ambient air has no access. Particularly in the region of the blade leading edge 10, the tubes 7 are arranged in such a way that the laser point of action 8 is flooded with the gas from several sides—from the suction side and the pressure side of the turbine blade 2, for example. This ensures that the laser point of action 8 remains free from oxygen even in the region of the blade leading edge 10. At the same time, the increased supply of gas ensures improved cooling of the treated region located at the blade leading edge 10.

During the process, the laser 5 used as the high-power energy source is moved cyclically relative to the turbine blade 2. A cyclic motion can—as is apparent from the FIGURE—be a reciprocating motion taking place along the coordinate axis y, a slight advance in the direction of the coordinate axis x taking place at each reversal position. By means of a pivoting motion of the radiation head 6 about the coordinate axis x, with simultaneous motion of the radiation head 6 along the coordinate axis z, the blade leading edge 10 can be subjected to the laser beam on the suction side and on the pressure side during a reciprocating motion. During this process, the part of the surface of the basic titanium alloy located at the laser point of action 8 becomes molten and alloying elements are introduced into the melt from the gas supplied through the tubes 7. In the gas mixture shown in the FIGURE, nitrogen is introduced as the alloying element. This, together with the titanium of the molten basic alloy, forms an extremely hard titanium nitride. Titanium boride and/or titanium carbide can also be correspondingly formed by using an appropriate composition of the gas supplied.

The protective layer formed by remelt alloying in the course of this surface treatment exhibits a resistance to erosion by the incidence of water droplets which is many times greater than that of the unprotected surface of the basic titanium alloy. The protective layer should have a minimum thickness of 0.1 mm because, otherwise, surface areas which are still unprotected could remain due to unavoidable non-uniformities in the remelting procedure. On the other hand, the thickness of the protective layer should not exceed 1 mm because only then is particularly good resistance to cracks, and therefore particularly good erosion protection, ensured. The formation of undesirable cracks can be avoided with a high level of certainty in the case of layer thicknesses between 0.4 and 1 mm if, during the remelting procedure, the laser parameters have been adjusted in such a way that the protective layer formed exhibits a maximum Vickers hardness of 900 HV, preferably between 500 and 700 HV.

The traces 11 formed by the laser 5 in the basic titanium alloy during the production of the protective layer should be laid in such a way that they overlap by between 50 and 90%, preferably between 75 and 85%, because particularly good alloying of the alloying elements, such as, in particular, the nitrogen during the formation of titanium nitride, is then ensured.

When using a basic titanium alloy with 6 percent by weight of aluminum and 4 percent by weight of vanadium, the following operating parameters of the laser 5 are typical for the manufacture of an erosion-resistant protective layer with a thickness of between approximately 0.6 and 0.7 mm and a Vickers hardness of between 500 and 700 HV:

| | |
|---|---|
| Power: | 1–10 kW |
| Advance in the trace direction: | 1–2 m/min |
| Trace overlap: | 75–85% |
| Diameter of the laser point of action: | approx. 2 mm |
| Composition of the gas: | Volume proportions $N_2$:Ar approx. 3:2 |
| Gas quantity: | approx. 50 l/min |

Generally speaking, it is sufficient if a blade region of the turbine blade 2 has the protective layer which is located near the blade tip and includes the blade leading edge 10 and an area located on the suction side. This area is generally bounded by the blade leading edge 10 and the blade tip and extends, as a maximum, by a third of the width of the blade, from the blade leading edge 10 to the blade trailing edge, and a third of the length of the blade, from the blade tip to the blade root.

Obviously, numerous modifications and variations of the present invention are possible in light of the above teachings. It is therefore to be understood that within the scope of the appended claims, the invention may be practised otherwise than as specifically described herein.

It is claimed:

1. A turbine blade of a titanium base alloy having a blade region located near a blade tip thereof anti including a blade leading edge, the blade leading edge having a surface of an erosion resistant material which is more resistant to erosion than the titanium base alloy, the erosion resistant material comprising a protective layer formed by remelt alloying of the titanium base alloy carried out in a gas which forms together with the titanium base alloy, at least one of a boride, carbide and nitride, the protective layer having a minimum thickness of 0.1 mm and a maximum thickness of 0.7 mm and a maximum Vickers hardness of 600 HV.

2. The turbine blade as claimed in claim 1, wherein the protective layer contains titanium nitride.

3. A method of forming a protective layer on a blade region of a turbine blade of a titanium base alloy, comprising steps of:

melting a surface layer of a turbine blade consisting essentially of a titanium base alloy by applying a high-power energy source to the surface layer, the surface layer being located in a blade leading edge of the turbine blade;

remelt alloying of the surface layer by exposing the surface layer to a gas during the melting step, the gas and the titanium base alloy reacting and forming at least one of a boride, carbide and nitride during the remelt alloying step, the protective layer having a minimum thickness of 0.1 mm and a maximum thickness of 0.7 mm and a maximum Vickers hardness of 600 HV.

4. The method as claimed in claim 3, wherein a nitrogen/inert gas mixture is used as the gas.

5. The method as claimed in claim 3, wherein a cyclically moving laser is used as the high-power energy source.

6. The method as claimed in claim 5, further comprising forming traces of melted material in the protective layer with the laser and overlapping the traces of melted material by between 70 and 90%.

7. The method as claimed in claim 6, wherein the traces are flooded with the gas from several sides.

8. The method as claimed in claim 5, further comprising forming traces of melted material in the protective layer with the laser and overlapping the traces of melted material by between 75 and 85%.

9. The method as claimed in claim 3, wherein the gas comprises an oxygen-free gas.

* * * * *